US012742446B2

(12) United States Patent
Beyer

(10) Patent No.: US 12,742,446 B2
(45) Date of Patent: Sep. 22, 2026

(54) RECIPROCATING PUMP SEAL DEVICES, AND ASSOCIATED SYSTEMS AND METHODS

(71) Applicant: Patriot Acquisitions, LLC, Salem, OR (US)

(72) Inventor: Glenn Beyer, Silverton, OR (US)

(73) Assignee: Patriot Acquisitions, LLC, Salem, OR (US)

( * ) Notice: Subject to any disclaimer, the term of this patent is extended or adjusted under 35 U.S.C. 154(b) by 0 days.

(21) Appl. No.: 19/063,231

(22) Filed: Feb. 25, 2025

(65) Prior Publication Data

US 2026/0251133 A1 Aug. 27, 2026

(51) Int. Cl.
*F04B 39/04* (2006.01)
*F04B 19/22* (2006.01)

(52) U.S. Cl.
CPC ..... *F04B 39/041* (2013.01); *F04B 19/22* (2013.01)

(58) Field of Classification Search
CPC ..... F04B 39/041; F04B 19/22; F04B 43/028; F04B 45/045; F04B 43/0054; F04B 43/026; F04B 45/04
USPC ..... 417/53, 533, 44.9, 395, 413.1, 480; 92/98 R, 100, 96, 99
See application file for complete search history.

(56) References Cited

U.S. PATENT DOCUMENTS 3,075 A * 5/1843 Barron ..... 417/480
10,428 A * 1/1854 Hitchcock ..... F04B 43/0054 417/559
1,484,115 A * 2/1924 Eells ..... F04B 43/0054 92/100
1,562,069 A * 11/1925 Arringdale ..... F04B 43/0054 92/99
1,659,860 A * 2/1928 Denholm ..... F04B 9/02 92/99
1,767,934 A * 6/1930 Longenecker ..... F04B 43/028 92/99
1,976,098 A * 10/1934 Smith ..... F04B 39/102 417/571
2,230,595 A * 2/1941 Horton ..... B60C 23/14 92/100
2,236,244 A * 3/1941 Cornelius ..... F04B 45/045 417/372
2,240,371 A * 4/1941 Linch ..... F04B 43/026 92/13.7

(Continued)

*Primary Examiner* — Benjamin Doyle
(74) *Attorney, Agent, or Firm* — Ashurst Perkins Coie US LLP; Michael A. Glenn; Benjamin Desch

(57) ABSTRACT

Reciprocating pump seal devices, systems, and methods are disclosed. A pump system comprises first and second assemblies. The first assembly includes a housing, suction and discharge nozzles coupled to the housing, and an actuator apparatus contained within the housing and configured to drive flow of a substance from the suction nozzle to the discharge nozzle. The actuator apparatus includes a first section with a first notch, a second section coupled to the first section and including a second notch, and a seal clamped between the first and second sections via the first and second notches. The seal is configured such that leakage of the substance around a perimeter of the actuator apparatus is mitigated and/or prevented when the seal is clamped between the first and second sections and when the pump is operating. The second assembly includes a piston that drives reciprocating motion of the actuator apparatus.

20 Claims, 4 Drawing Sheets

(56) References Cited

U.S. PATENT DOCUMENTS 2,258,009 A * 10/1941 Horton ..... B60K 25/00 417/313
2,278,832 A * 4/1942 Cornelius ..... F04B 39/066 D15/7
2,367,184 A * 1/1945 Byroad ..... F04B 43/023 92/48
2,430,545 A * 11/1947 Wesley ..... F04B 43/028 417/480
2,463,766 A * 3/1949 Hadley ..... F04B 39/06 417/571
2,491,230 A * 12/1949 Theis ..... F04B 43/026 74/25
2,631,538 A * 3/1953 Johnson ..... F04B 43/025 92/84
2,819,013 A * 1/1958 Paasche ..... F16K 15/066 137/565.17
2,839,086 A * 6/1958 Engelberger ..... G05D 23/12 92/96
3,434,808 A * 3/1969 Pobst, Jr. ..... F04B 53/1032 406/96
3,645,651 A * 2/1972 Bills ..... F04B 39/0055 417/550
3,650,639 A * 3/1972 Greene ..... F04B 39/066 417/413.1
4,097,203 A * 6/1978 Selwood ..... F04B 43/028 417/525
4,124,334 A * 11/1978 Mazzetti ..... F04B 43/0054 92/100
4,141,467 A * 2/1979 Augustijn ..... F04B 9/1035 137/99
4,286,932 A * 9/1981 Nagano ..... F04B 45/043 92/100
4,293,285 A * 10/1981 Burton ..... F04B 43/028 417/240
4,818,191 A * 4/1989 Schlake ..... F04B 9/113 91/275
5,724,881 A * 3/1998 Reynolds ..... F04B 43/0054 92/100
5,927,954 A * 7/1999 Kennedy ..... F04B 43/0736 417/397
2003/0039563 A1 * 2/2003 Arbuckle ..... F04B 43/026 417/413.1
2003/0110939 A1 * 6/2003 Able ..... F04B 43/0054 92/98 R

* cited by examiner

RECIPROCATING PUMP SEAL DEVICES, AND ASSOCIATED SYSTEMS AND METHODS

TECHNICAL FIELD

The present technology is directed toward pump seal devices, and specifically to reciprocating pump seal devices, and associated systems and methods.

BACKGROUND

The internal components of pumps are subjected to various stresses during operation, which can lead to wear and tear that often necessitates regular maintenance and replacement. For example, mechanical stresses such as cyclic loading (e.g., due to the back-and-forth motion of a piston or plunger) can lead to fatigue in components such as the piston, actuating rod, and/or mechanical linkages. Vibration from high-speed operation can cause loosening of fasteners, misalignment, and eventual component failure. Changes in pressure, temperature, or flow can create impact loads and/or erode valves, seals, and other internal components, leading to pump damage. To mitigate these issues, inspection and component repair/replacement are often performed. However, inspection, repair, and replacement of many internal components of pumps can be technically challenging, time-intensive, and expensive.

DETAILED DESCRIPTION

A. Introduction

Figure 1A:
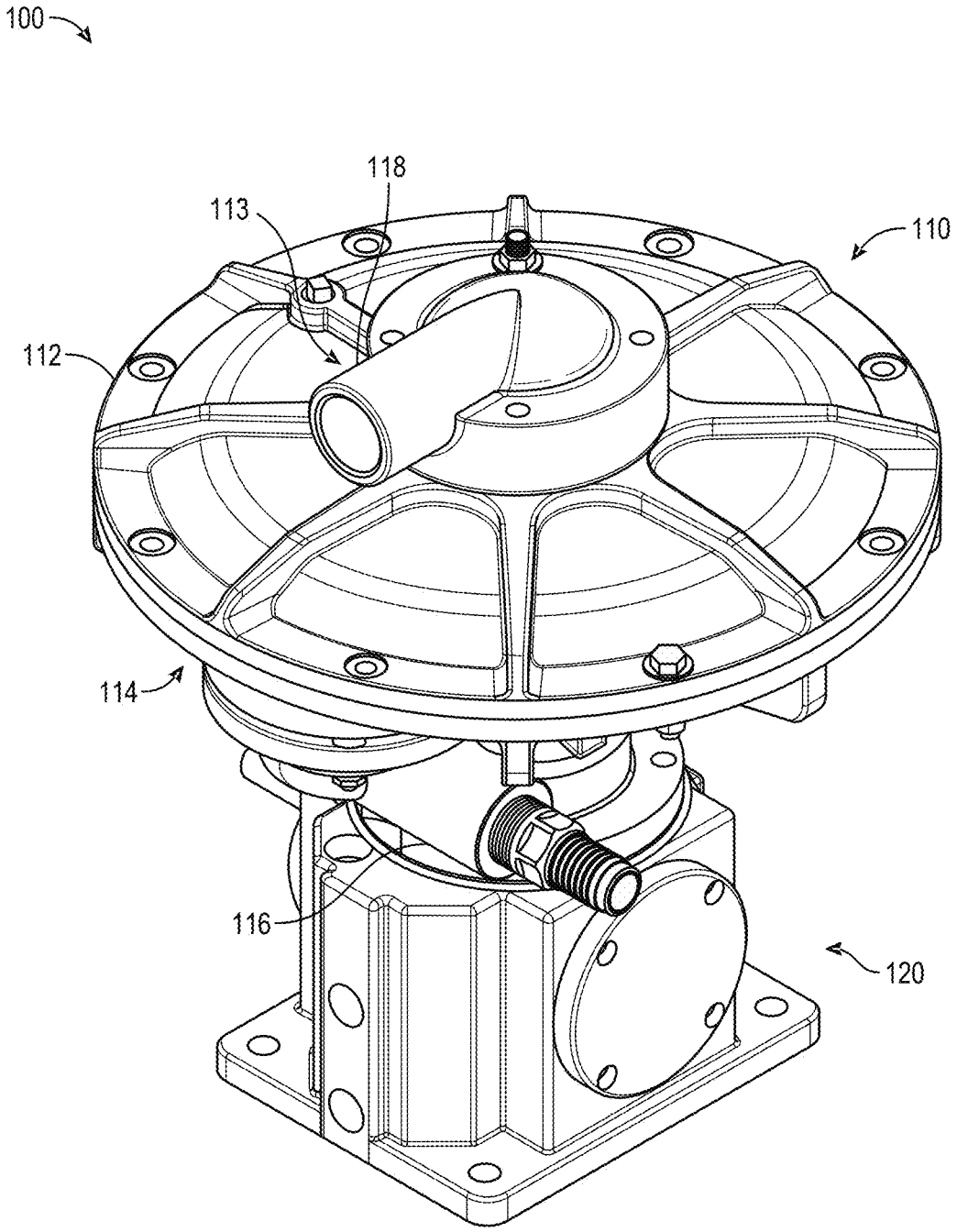
FIG. 1A is a perspective view of a pump system, in accordance with some embodiments of the present technology.

The present technology provides reciprocating pump seal devices, and associated systems and methods. For example, the present technology provides a reciprocating pump system comprising a first assembly and a second assembly. The first assembly includes a housing, suction and discharge nozzles coupled to the housing, and an actuator apparatus contained within the housing and configured to drive flow (e.g., via drawing/creating a vacuum and/or generating a pressure gradient) of a substance (e.g., gas, particulates, liquid, etc.) from the suction nozzle to the discharge nozzle. The actuator apparatus includes a first section (e.g., a first disk, plate, etc.) with a first notch, a second section (e.g., a second disk, plate, etc.) coupled to the first section and including a second notch, and a seal clamped between the first and second sections via the first and second notches. The seal is configured such that leakage of the substance around a perimeter of the actuator apparatus is substantially mitigated and/or prevented (e.g., no leakage or nearly no leakage) when the seal is clamped between the first and second sections and when the pump is operating (i.e., when flow is being driven from suction to discharge). The second assembly includes a piston configured to drive reciprocating motion of the actuator apparatus.

The first and second sections are configured such that, when they are decoupled, the seal becomes unclamped and can be easily lifted out of the first assembly housing without having to stretch and/or deform the seal during removal. A new seal can be easily installed, for example, by placing the new seal in the second notches of the second section and positioning the first notches of the first section on the seal, clamping the seal in place. Thus, the present technology facilitates rapid replacement of the seal, which can greatly reduce service time and expense. Seal replacement/inspection is also simplified, making it easier for skilled and unskilled workers alike to perform maintenance and inspection of the actuator, seal, and/or other internals of the pump. Furthermore, in some embodiments, the present technology can be configured to include one or more internal/interstitial spaces (discussed further below), which can reduce the weight of the actuator apparatus and use less material relative to conventional actuators/pump systems.

In some embodiments, the seal includes a first lip on a first side of the seal configured to mate with the first notch, and a second lip on a second side of the seal opposite the first side, which is configured to mate with the second notch. In some embodiments, the first and second notches extend around the first and second sections, respectively, to form first and second rings recessed in first and second surfaces of the first and second sections. In such embodiments, the first and second lips of the seal extend in corresponding ring shapes to mate with the first and second recessed rings, respectively.

In some embodiments, the suction nozzle is positioned on a first portion of the housing, and the discharge nozzle is positioned on a second portion of the housing opposite the first portion of the housing. For example, the suction nozzle can be positioned on a bottom portion of the housing, and the discharge nozzle can be positioned on a top portion of the housing.

In some embodiments, the second section includes one or more raised segments positioned between the edge (e.g., the perimeter) of the second section and the center of the second section, where each raised segment is configured to receive a coupling element (e.g., a threaded fastener, a bolt, a pin, a dowel, and the like) configured to couple the first section with the second section. In some embodiments, internal/interstitial spaces are formed between one or more of the raised segments and the edge of the second section, and between one or more of the raised segments and the center of the second section.

In some embodiments the first section includes a circular center opening and the second section includes a raised center portion, where the circular center opening of the first section is configured to fit over the raised center portion of the second section when the first section is coupled to the second section. For example, the raised center portion of the second section can include a center lip that extends away from the rest of the raised center portion to form a shelf, which can be configured to receive the circular center opening of the first section. The first section can thus fit over and be in contact with the circular center lip and/or shelf of the raised center portion such that the circular center lip extends at least partially through the circular center opening. The raised center portion, circular center lip, and/or shelf can, for example, provide structural stability and horizontal/vertical support for the first section when the first and second sections are coupled, as well as help align the circular center opening of the first section with a flow path through the actuator apparatus.

In some embodiments, the raised center portion of the second section includes a center recess configured to receive a valve, where the valve is configured to permit (e.g., control the transmission of) flow through the raised center portion of the second section and/or through the circular center opening of the first section.

These and other aspects, features, and implementations can be expressed as methods, apparatuses, systems, components, program products, means or steps for performing a function, and in other ways. These and other aspects, features, and implementations will become apparent from the following descriptions, including the claims.

In the following description, for the purposes of explanation, numerous specific details are set forth in order to provide a thorough understanding of the present embodiments. It will be apparent, however, that the present embodiments may be practiced without these specific details.

B. Reciprocating Pump Seal Devices, and Associated Systems and Methods

Figure 1B:
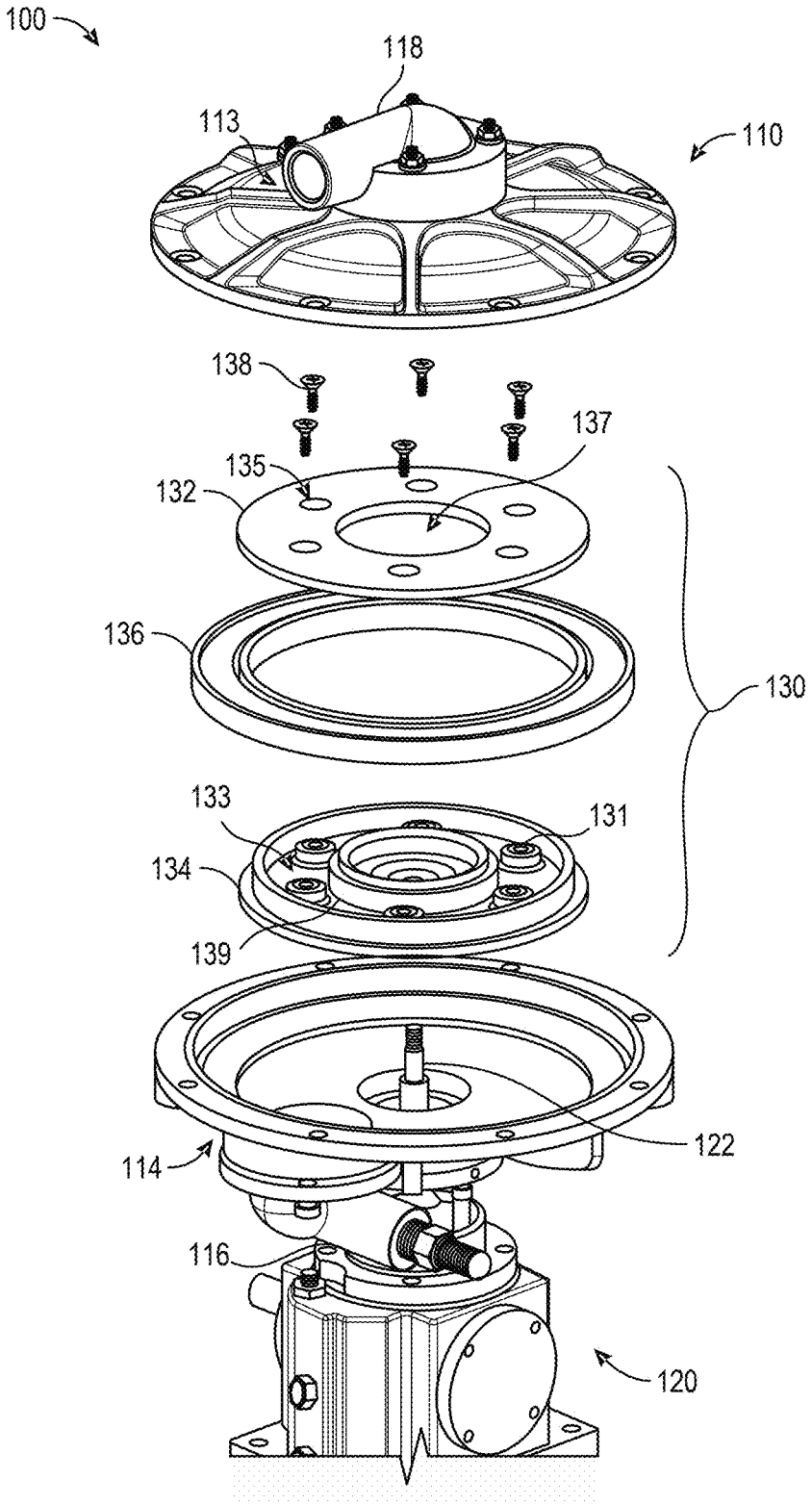
FIG. 1B is an exploded view of the pump system of FIG. 1A.

FIG. 1A is a perspective view of a pump system 100, in accordance with some embodiments of the present technology. FIG. 1B is an exploded view of the pump system 100 of FIG. 1A. In the present embodiments, the pump system 100 is represented as a reciprocating pump for drawing/creating vacuum in an external pump system (e.g., an external centrifugal pump), but a person of ordinary skill in the art will recognize that the present technology can be applied to and/or incorporated into other pump types and/or pump systems (e.g., diaphragm pumps, screw pumps, etc.).

The system 100 includes a first assembly 110 and a second assembly 120. In some embodiments, the first assembly 110 includes a housing 112 containing an actuator apparatus 130 (shown in FIG. 1B), a suction nozzle 116, and a discharge nozzle 118.

The suction nozzle 116 is coupled to a first portion 114 of the housing 112, and the discharge nozzle 118 is coupled to a second portion 113 of the housing. In some embodiments, the first portion 114 is positioned opposite the second portion 113. For example, the first portion 114 can be positioned on a bottom portion of the housing 112, which corresponds to an inlet side (not shown) of the actuator apparatus 130, and the second portion 113 can be positioned on a top portion of the housing 112, which corresponds to an outlet side (not shown) of the actuator apparatus 130. In some embodiments, the position of the suction nozzle 116 and the position of the discharge nozzle 118 is based on a flow and/or flow path of a substance (e.g., gas (such as air), particulate matter, liquid, etc.) through the actuator apparatus 130.

The suction nozzle 116 is configured to receive the flow of the substance from an external source (e.g., an external pump system, not shown) and to guide and/or direct the flow to the actuator apparatus 130 contained within the housing 112. The actuator apparatus 130 is configured to guide and/or drive the flow of the substance from the suction nozzle 116 to the discharge nozzle 118. The discharge nozzle 118 is configured to receive the flow of the substance from the actuator apparatus 130 and to guide and/or direct the flow away from the pump system 100. In some embodiments, the actuator apparatus 130 is configured to drive the flow of the substance by drawing/creating a vacuum in and/or relative to the external source, and/or generating a pressure differential across one or more components of the system 100 (e.g., the actuator apparatus 130) and/or the external source. For example, the actuator apparatus 130 can be configured to drive a flow of air entrained in a fluid flow path of an external centrifugal pump by drawing a vacuum in the centrifugal pump and/or generating a pressure differential that drives the entrained air from the centrifugal pump to the suction nozzle 116 of the first assembly 110, through the actuator apparatus 130, and to the discharge nozzle 118. In some embodiments, an outlet of the discharge nozzle 118 is at least approximately at atmospheric pressure.

The actuator apparatus 130 (shown in FIG. 1B) includes a first section 132 (e.g., a top plate and/or disk), a second section 134 (e.g., a bottom plate and/or disk), and a seal 136 (e.g., a gasket). The first section 132 is configured to couple to the second section 134 via one or more coupling elements 138 (e.g., threaded fasteners, clamps, etc.). The seal 136 is configured to be clamped and/or secured between the first and second sections 132, 134 when the first section 132 is coupled to the second section 134.

In some embodiments, the first section 132 includes a center opening 137 configured to fit over and/or contact a raised center portion 139 of the second section 134. For example, the first section 132 can be coupled to the second section 134 such that the center opening 137 rests on and/or is supported by a shelf of the raised center portion 139 (discussed further in FIGS. 2A-2B). In some embodiments, the actuator apparatus 130 is configured to drive and/or direct the flow of the substance from the suction nozzle 116 through the raised center portion 139 and center opening 137 to the discharge nozzle 118.

In some embodiments, the first section includes one or more coupling element holes 135. The coupling element holes 135 are configured to receive and/or guide the one or more coupling elements 138 to the second section 134. In some embodiments, the second section includes one or more raised segments 131 positioned between at least an approximate center of the second section 134 and an outer edge and/or rim of the second section 134. The raised segments 131 are configured to receive the coupling elements 138 passing through the coupling element holes 135. In some embodiments, the second section 134 is coupled to the first section 132 via the coupling elements 138 binding with at least a portion of one or more of the raised segments 131.

In some embodiments, the second section 134 includes one or more interstitial (e.g., inner) spaces 133 between the raised center portion 139 and the outer edge and/or rim of the second section 134. In some embodiments, the one or more raised segments 131 are positioned in one or more of the interstitial spaces 133.

In some embodiments the seal 136 is comprised of a material configured to prevent leakage of the substance through the seal 136 and/or through or around (e.g., a perimeter) the first and/or second sections 132, 134. In some embodiments the material of the seal 136 is determined based on the substance being directed through the actuator apparatus 130. In some embodiments, the seal 136 is comprised of a synthetic rubber, such as nitrile rubber (i.e., Buna-N).

The second assembly 120 includes a piston 122 configured to drive reciprocating motion of the actuator apparatus 130. For example, the second assembly 120 can include one or more mechanical linkages (not shown) coupling the piston 122 to a rotating shaft component of an external electric motor (not shown). Rotation of the shaft component of the electric motor is converted to reciprocating motion of the piston 122 via the one or more mechanical linkages. The reciprocating motion of the piston 122 subsequently drives reciprocating motion of one or more components of the actuator apparatus 130. In some embodiments, reciprocating motion of the one or more components of the actuator apparatus 130 drives the flow of the substance from the suction nozzle 116 to the discharge nozzle 118. For example, reciprocating motion of the one or more components of the actuator apparatus 130 can generate a pressure differential that drives the flow of the substance from the suction nozzle 116 (and/or external systems coupled to the suction nozzle) to the discharge nozzle 118.

Figure 2A:
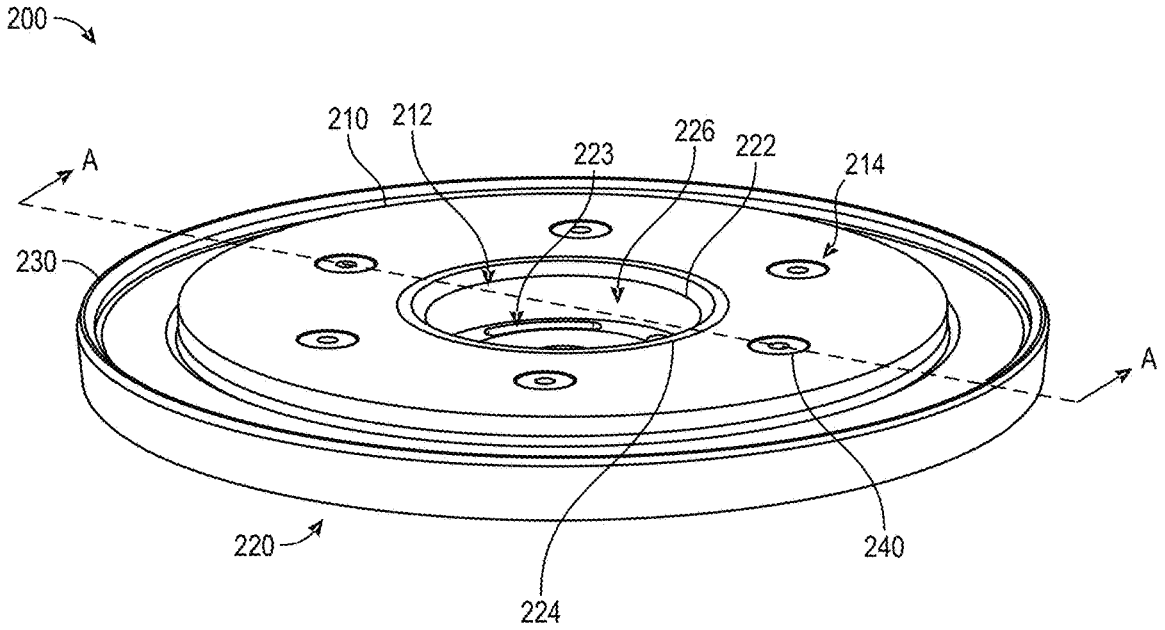
FIG. 2A is a perspective view of an actuator apparatus, in accordance with some embodiments of the present technology.
Figure 2B:
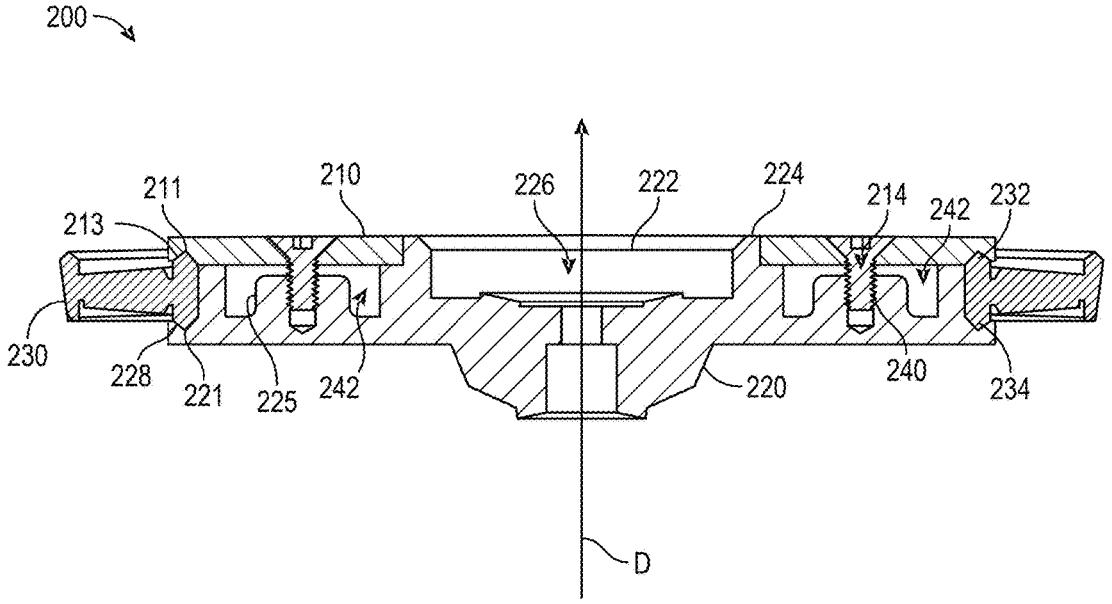
FIG. 2B is a cross-sectional view of the actuator apparatus of FIG. 2A taken at cross-section A-A.

FIG. 2A is a perspective view of an actuator apparatus 200, in accordance with some embodiments of the present technology. FIG. 2B is a cross-sectional view of the actuator apparatus 200 of FIG. 2A taken at cross-section A-A. In some embodiments, the actuator apparatus 200 includes one or more features and/or components similar/identical to the features and/or components of the actuator apparatus 130 discussed with reference to FIGS. 1A-1B.

Referring to FIGS. 2A and 2B together, in the present embodiments, actuator apparatus 200 includes a top plate 210, a bottom plate 220, and a seal 230. The top plate 210 is configured to couple to the bottom plate 220 such that the seal 230 is clamped between the top and bottom plates 210, 220.

In some embodiments, the top plate 210 includes a center opening 212 and one or more coupling element openings 214. The center opening 212 is positioned at least approximately about a center point of the top plate 210. The one or more coupling element opening 214 are positioned between the center point of the top plate 210 and an outer edge and/or rim of the top plate 210. In some embodiments, each of the coupling element openings 214 are positioned at least approximately the same distance from the center point and/or the outer edge and/or rim of the top plate 210. The rim and/or edge of the center opening 212 is configured to fit over and/or contact at least a portion of the bottom plate 220 when the top plate 210 is coupled to the bottom plate 220. For example, the bottom plate 220 can provide physical support and/or flow path alignment to center opening 212 when the top and bottom plates 210, 220 are coupled together. The coupling element openings 214 are configured to receive and/or guide one or more coupling elements 240 to corresponding coupling fixtures of the bottom plate 220 (e.g., one or more raised segments 225).

In some embodiments, the bottom plate 220 includes a raised center portion 222 with a raised lip 224, a center recess 226 positioned in the raised center portion 222, one or more raised segments 225, and one or more interstitial spaces 242 extending between the raised center portion 222 and an outer edge and/or rim of the bottom plate 220.

The raised center portion 222 is configured to receive and support the top plate 210, as well as help guide and/or direct the flow of the substance through the actuator apparatus 200 (illustrated via flow direction D in FIG. 2B). For example, the raised center portion 222 can include one or more openings 223 in a bottom area of the raised center portion 222 and/or bottom plate 220 through which the substance can flow. As another example, the raised center portion 222 can include a center recess 226 configured to receive a valve (not pictured) that can control the flow of the substance through the raised portion 222 and/or bottom plate 220. In some embodiments, the raised center portion 222 includes a raised lip 224 configured to receive and/or physically support the top plate 210. For example, the raised lip 224 can form a shelf which the top plate 210 can sit upon and/or mate with (e.g., via a rim of the center opening 212).

The one or more raised segments 225 are positioned between at least an approximate center point of the bottom plate 220 and an outer edge and/or rim of the bottom plate 220. The raised segments 225 are configured to receive and/or couple with one or more coupling elements 240 (e.g., threaded fasteners). In some embodiments the raised segments 225 are configured to extend from the bottom plate 220 to the top plate 210 when the top and bottom plates 210, 220 are coupled such that the raised segments 225 are in contact with the top plate 210 when the top and bottom plates 210, 220 are coupled. This can, for example, provide structural support and stability to the top plate 210. In some embodiments, the raised segments 225 do not extend all the way to the top plate 210 when the top and bottom plates 210, 220 are coupled, instead allowing an open and/or interstitial space 242 to extend between a top edge of the raised segments 225 and the top plate 210 when the top and bottom plates 210, 220 are coupled (as shown in FIG. 2B). This can, for example, reduce the amount of material used to manufacture the actuator apparatus 200 and/or reduce the overall weight of the actuator apparatus 200. In some embodiments, interstitial spaces 242 are formed (e.g., when the top and bottom plates 210, 220 are coupled) and/or positioned between at least the approximate center point of the actuator apparatus 200 and an outer edge and/or rim of the actuator apparatus 200, to reduce the weight and amount of material of the actuator apparatus 200.

In some embodiments, the seal 230 includes first and second lips 232, 234. The first and second lips 232, 234 are configured to mate with corresponding first and second notches 213, 228 positioned in the top and bottom plates 210, 220, respectively. The first and second lips 232, 234 and first and second notches 213, 228 are configured to provide additional grip and/or securing force between the seal 230 and the top and bottom plates 210, 220 when the first and second lips 232, 234 are mated with the first and second notches 213, 228. The first and second lips 232, 234 and first and second notches 213, 228 also reduce the ability of leakage of the substance through the interface between the seal 230 and the top and bottom plates 210, 220 by creating a tortuous flow path between the seal 230 and the top and bottom plates 210, 220.

In some embodiments, the first notch 213 extends around at least an approximate circumference of the top plate 210 to form a ring-shaped recess in a first surface 211 of the top plate 210. The second notch 228 extends around at least an approximate circumference of the bottom plate 220 to form a ring-shaped recess in a second surface 221 of the bottom plate 220. The first and second ring-shaped recesses 213, 228 in the first and second surfaces 211, 221 are configured to receive and/or mate with the first and second lips 232, 234 of the seal 230. The ring-shape of the recesses 213, 228 can, for example, increase the grip and/or securing force between the seal 230 and the top and bottom plates 210, 220 by increasing the contact surface area between the seal 230 and the top and bottom plates 210, 220.

Figure 3:
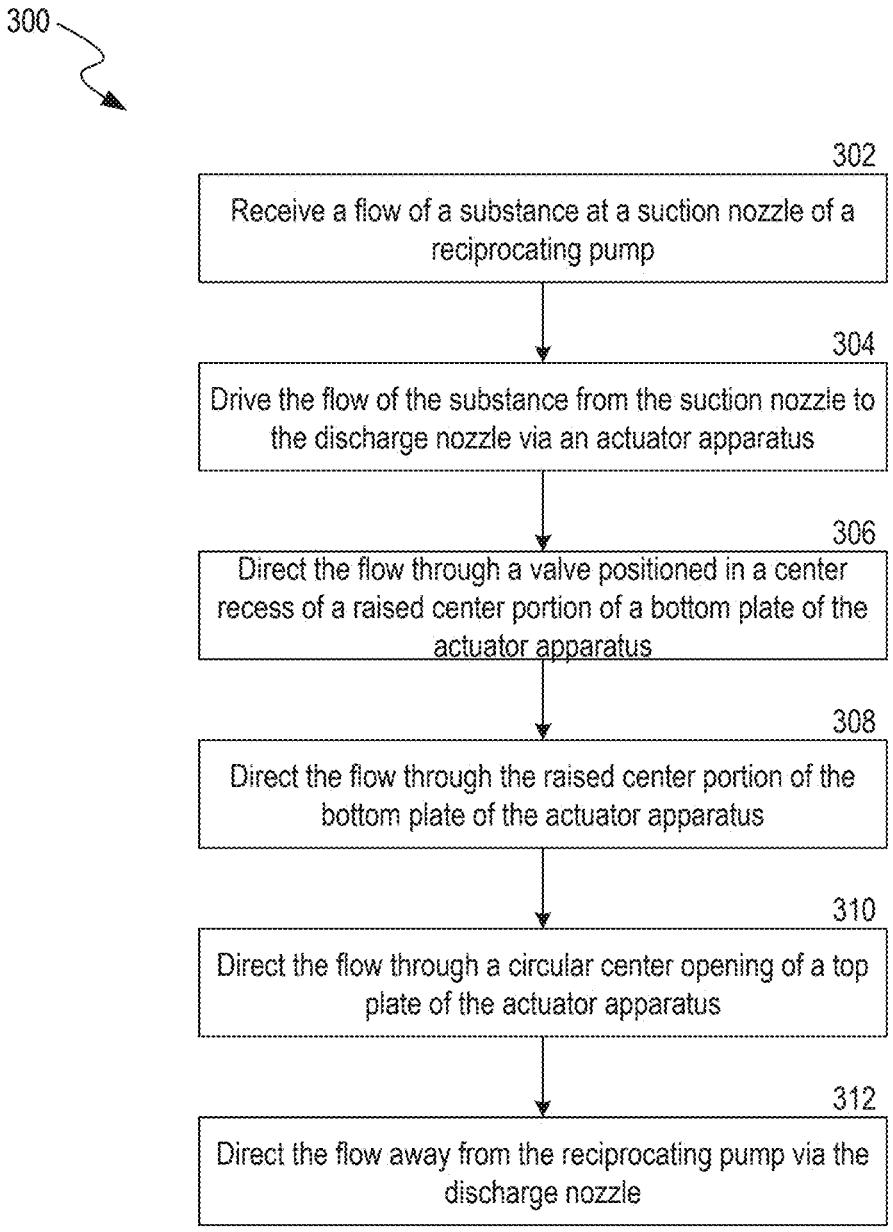
FIG. 3 is a flow diagram of a method, in accordance with some embodiments of the present technology.

FIG. 3 is a flow diagram of a method 300, in accordance with some embodiments of the present technology. In some embodiments, the method 300 is implemented via one or more features and/or components of the pump system 100 of FIGS. 1A-1B and/or the actuator apparatus 200 of FIGS. 2A-2B.

At block 302, a flow of a substance is received at a suction nozzle of a pump. For example, a fluid, such as water or air, can be received at a suction nozzle of a reciprocating pump (e.g., a vacuum priming pump) from an external source. In some embodiments, the suction nozzle is positioned on a first portion of a housing of the pump (e.g., a bottom portion of the housing of the first assembly 110, discussed in FIGS. 1A and 1B).

At block 304, the flow of the substance is driven from the suction nozzle to a discharge nozzle of the pump via an actuator apparatus, where the actuator apparatus includes a first section (e.g., a top plate) including a first notch, a second section (e.g., a bottom plate) coupled to the first section and including a second notch, and a seal clamped between the first and second sections via the first and second notches. In some embodiments, the flow of substance is driven by a vacuum force generated by reciprocating motion of the actuator apparatus. In some embodiments, the flow path of the substance includes passing from the suction nozzle, through openings of the actuator apparatus, and to the discharge nozzle.

In some embodiments, as shown at block 306, the flow of the substance is directed through a valve positioned in a center recess of a raised center portion of the second section of the actuator apparatus. For example, the flow of the substance can be driven from the suction nozzle through a valve positioned in the recess of the actuator apparatus.

In some embodiments, the flow of the substance is directed through the raised center portion of the second section, as shown in block 308, and/or through a circular center opening of the first section, as shown in block 310. In some embodiments, at least a part of the rim of the circular center opening of the first section is configured to fit over and/or contact the raised center portion.

At block 312, the flow of the substance is directed away from the pump via the discharge nozzle. In some embodiments, the discharge nozzle is configured to receive the flow of the substance from the actuator apparatus, and/or the valve, circular center opening, and/or raised center portion.

F. Conclusion

From the foregoing, it will be appreciated that specific embodiments of the disclosed technology have been described herein for purposes of illustration, but that various modifications may be made without deviating from the technology. Certain aspects of the technology described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the present technology. Accordingly, the disclosure and associated technology can encompass other embodiments not expressly shown or described herein.

The use of "and/or," as in "A and/or B" refers to A alone, B alone, and both A and B. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The description and drawings herein are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, but no special significance is to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only and is not intended to further limit the scope and meaning of the disclosure or of any exemplified term. Likewise, the disclosure is not limited to various embodiments given in this specification.

It is to be understood that the embodiments and variations shown and described herein are merely illustrative of the principles of this invention and that various modifications may be implemented by those skilled in the art.

I claim:

1. A reciprocating pump system comprising:

a first assembly including:

a housing;

a suction nozzle coupled to a first portion of the housing, the suction nozzle configured to receive a flow of a fluid;

a discharge nozzle coupled to a second portion of the housing, the discharge nozzle configured to discharge the flow of the fluid; and an actuator apparatus contained within the housing and configured to drive the flow of the fluid from the suction nozzle to the discharge nozzle, the actuator apparatus including:

a first section including a first notch and one or more coupling element openings;

a second section including a second notch and one or more raised segments;

one or more coupling elements configured to extend through the coupling element openings and be mated with the one or more raised segments; and a seal configured to be clamped between the first and second sections via the first and second notches when the one or more coupling elements extend through the coupling element openings and are mated with the one or more raised segments, wherein the seal is configured to prevent leakage of the fluid around a perimeter of the actuator apparatus; and a second assembly coupled to the first assembly, the second assembly including a piston configured to drive reciprocating motion of the actuator apparatus.

2. The pump system of claim 1 wherein the seal includes:

a first lip on a first side of the seal configured to mate with the first notch; and a second lip on a second side of the seal opposite the first side, the second lip configured to mate with the second notch.

3. The pump system of claim 1 wherein the first and second portions of the housing are on opposite sides of the housing.

4. The pump system of claim 1 wherein the one or more raised segments are positioned between an edge of the second section and a center of the second section.

5. The pump system of claim 1 wherein the one or more coupling elements are threaded fasteners.

6. The pump system of claim 1 wherein the first notch is shaped to form a first ring in the first section of the actuator apparatus, and wherein the second notch is shaped to form a second ring in the second section of the actuator apparatus.

7. The pump system of claim 1 wherein the first and second sections of the actuator apparatus are first and second disks, wherein the first disk includes a circular center opening and the second disk includes a raised center portion, and wherein the circular center opening of the first disk is configured to fit over the raised center portion of the second disk when the first disk is coupled to the second disk.

8. The pump system of claim 7 wherein the raised center portion of the second disk includes a circular center lip, and wherein the circular center opening of the first disk is configured to fit over and contact the circular center lip of the second disk such that the circular center lip extends at least partially through the circular center opening when the first disk is coupled to the second disk.

9. The pump system of claim 7 wherein the raised center portion of the second disk includes a center recess configured to receive a valve, and wherein the valve is configured to permit the flow of the fluid through the raised center portion of the second disk and through the circular center opening of the first disk.

10. An actuator apparatus of a reciprocating pump, the actuator apparatus comprising:

a top plate configured to be contained within a housing of the pump, the top plate including:

a first recess in a first surface of the top plate, the first recess forming a first ring in the first surface;

a bottom plate configured to be contained within the housing of the pump, the bottom plate including:

a second recess in a second surface of the bottom plate, the second recess forming a second ring in the second surface; and one or more raised segments configured to mate with one or more coupling elements;

wherein the one or more coupling elements are configured to couple the bottom plate to the top plate when the coupling elements are mated with the one or more raised segments; and a seal configured to be clamped between the first surface of the top plate and the second surface of the bottom plate via the first and second recesses when the bottom plate is coupled to the top plate;

wherein the actuator apparatus is configured to drive a flow of a fluid from a suction nozzle to a discharge nozzle of the pump, and wherein the seal is configured to prevent leakage of the fluid around a perimeter of the actuator apparatus.

11. The apparatus of claim 10 wherein the seal includes:

a first lip on a first side of the seal configured to mate with the first recess; and a second lip on a second side of the seal opposite the first side, the second lip configured to mate with the second recess.

12. The apparatus of claim 10 wherein the one or more raised segments are positioned between an edge of the bottom plate and a center of the bottom plate.

13. The apparatus of claim 10 wherein the flow of fluid is a flow of gas.

14. The apparatus of claim 10 wherein the top plate includes a circular center opening and the bottom plate includes a raised center portion, and wherein the circular center opening of the top plate is configured to fit over the raised center portion of bottom plate when the top plate is coupled to the bottom plate.

15. The apparatus of claim 14 wherein the raised center portion of the bottom plate includes a circular center lip, and wherein the circular center opening of the top plate is configured to fit over and contact the circular center lip of the bottom plate such that the circular center lip extends at least partially through the circular center opening when the top plate is coupled to the bottom plate.

16. The apparatus of claim 14 wherein the raised center portion of the bottom plate includes a center recess configured to receive a valve, and wherein the valve is configured to permit the flow of the fluid through the raised center portion of the bottom plate and through the circular center opening of the top plate.

17. A method comprising:

receiving a flow of a fluid at a suction nozzle of a reciprocating pump;

driving the flow of the fluid from the suction nozzle to a discharge nozzle of the reciprocating pump via an actuator apparatus, wherein the actuator apparatus includes a first section including a first notch, a second section including a second notch and one or more raised segments configured to mate with one or more coupling elements, wherein the first and second sections are coupled when the one or more coupling elements are mated with the one or more raised segments, and a seal clamped between the first and second sections via the first and second notches such that leakage of the fluid around a perimeter of the actuator apparatus is substantially prevented; and directing the flow of the fluid away from the reciprocating pump via the discharge nozzle.

18. The method of claim 17, further comprising directing the flow of the fluid through a circular center opening of the first section.

19. The method of claim 18, further comprising directing the flow of the fluid through a raised center portion of the second section, wherein the circular center opening of the first section is configured to fit over the raised center portion of the second section when the first section is coupled to the second section.

20. The method of claim 19, further comprising directing the flow of the fluid through a valve positioned in a center recess of the raised center portion of the second section.

* * * * *